United States Patent [19]

Ford, Jr. et al.

[11] 4,185,717

[45] Jan. 29, 1980

[54] ENGINE LUBRICATING OIL PUMP

[75] Inventors: Harry S. Ford, Jr., Birmingham; Nshan Hamparian, Brighton; Tanas M. Sihon, Ann Arbor, all of Mich.

[73] Assignee: General Motors Corporation, Detroit, Mich.

[21] Appl. No.: 903,926

[22] Filed: May 8, 1978

[51] Int. Cl.[2] ..... F16H 41/00; F15B 9/02

[52] U.S. Cl. ..... 184/6.28; 184/31; 123/196 R; 418/171

[58] Field of Search ..... 418/171; 184/31, 33, 184/6.28; 123/196 R

[56] References Cited

U.S. PATENT DOCUMENTS

| | | | |
|---|---|---|---|
| 1,456,461 | 5/1923 | Page | 184/6.28 |
| 2,277,270 | 3/1942 | Schmitter et al. | 184/31 X |
| 2,883,001 | 4/1959 | Dierksen | 184/31 |
| 2,989,951 | 6/1961 | Charlson | 418/171 X |
| 3,016,834 | 1/1962 | Deska et al. | 418/171 |
| 3,391,608 | 7/1968 | Huber | 418/171 |
| 3,407,741 | 10/1968 | Weber et al. | 184/31 X |
| 3,443,378 | 5/1969 | Monroe et al. | 418/171 X |

FOREIGN PATENT DOCUMENTS

| | | | |
|---|---|---|---|
| 19872 | of 1911 | United Kingdom | 418/171 |

*Primary Examiner*—David H. Brown
*Attorney, Agent, or Firm*—Donald F. Scherer

[57] ABSTRACT

A gear-type lubrication pump for an internal combustion engine wherein the pump housing and oil porting are formed in the engine block and one pump gear is rotatably supported in a bushing mounted in the engine block. The other pump gear is rotatably mounted on a bearing supported in the pump housing on a fastener which also locates a cover plate and seal in position to abut the outside face of the one gear and prevent leakage from the pump housing.

1 Claim, 2 Drawing Figures

ENGINE LUBRICATING OIL PUMP

This invention relates to pumps and more particularly to lubrication pumps for internal combustion engines.

It is an object of this invention to provide an improved lubrication pump for an internal combustion engine, wherein the pump cavity, for housing the pump gears, and oil passages are formed in the engine block and wherein the pump gears are supported on respective bearings in the pump cavity and wherein one bearing is supported on a member which also supports a cover and end seal for the pump.

Figure 1:
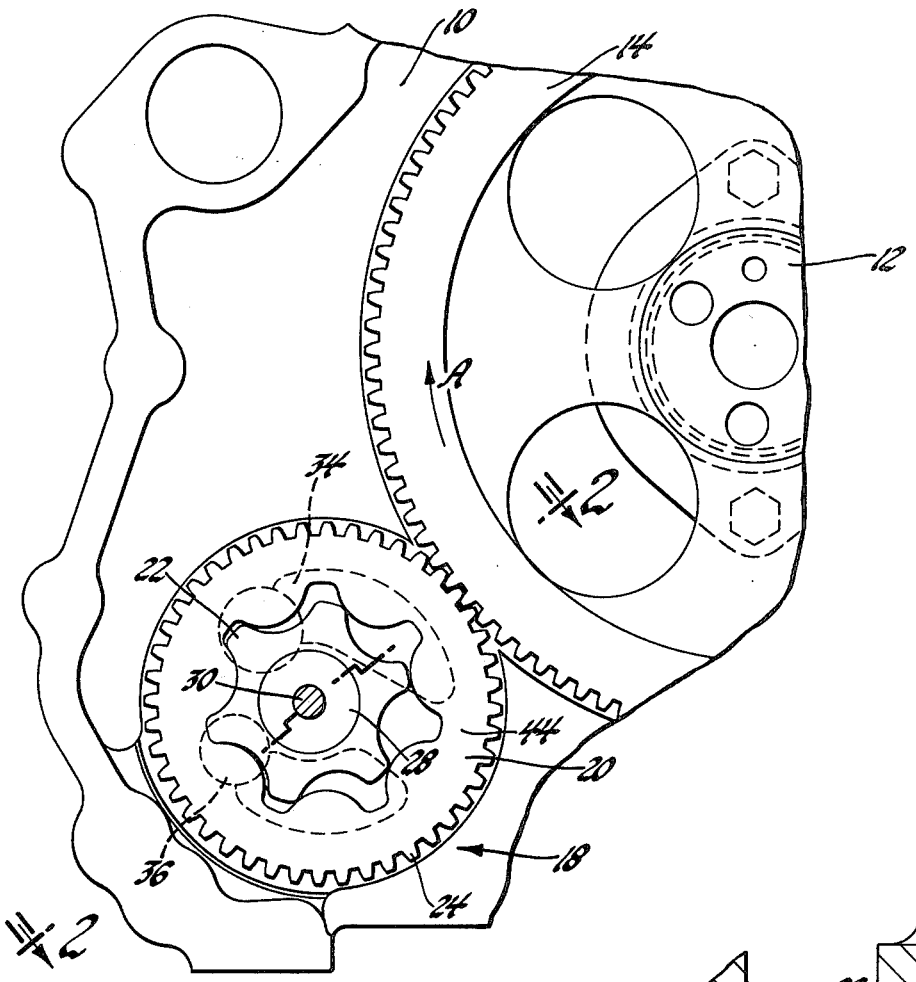
Figure 2:
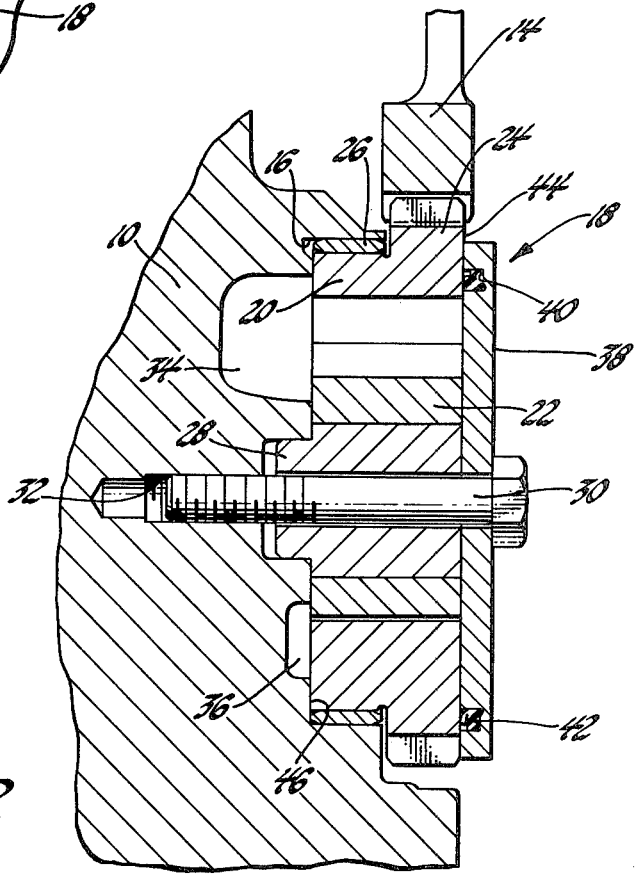

These and other objects and advantages of the present invention will be more apparent from the following description and drawings in which:

FIG. 1 is an elevational view showing a portion of the engine and the pump with cover removed; and FIG. 2 is a sectional view taken along line 2—2 of FIG. 1.

Referring to the drawings, wherein like characters represent the same or corresponding parts, there is shown in FIG. 1, an engine cylinder block 10 in which is rotatably supported a crankshaft 12 having a drive gear 14 secured thereto. A cavity 16 is formed in the engine cylinder block, in which cavity 16 is disposed an internal/external type gear pump generally designated 18. The gear pump is comprised of an internally toothed external gear 20 and an externally toothed internal gear 22 which meshes with gear 20. The external gear 20 has formed thereon an externally toothed gear 24 which meshes with the engine driven gear 14. As can be seen in FIG. 2, the external gear 20 is rotatably mounted on a bushing or bearing 26 which is pressed into the cavity 16.

The internal gear 22 is rotatably supported on a bushing or bearing 28 which is supported on a threaded member 30 which is threaded into a threaded hole 32 formed in the engine block 10. Also formed in the engine block are a pair of oil passages 34 and 36 which serve to port oil to and from the pump 18.

A cover plate 38 is also supported on the threaded member 30, in a position to seal the outer surface of gear 20. The cover plate 38 has an annular groove 40 formed therein, in which groove is disposed a lip seal member 42 which bears against the face 44 of the external gear 20. The other side of gear 20 is sealed by the end wall 46 of the cavity 16.

Assuming that the gear 14 is rotating in the direction of arrow A, the gear 24 will be driven thereby causing rotation of the external gear 20 of the gear pump 18. Rotation of the gear 20 causes rotation of the gear 22 in such a manner that oil between the teeth of the gears 20 and 22, as they come into mesh, is forced out through passage 34 and oil is taken in through passage 36 to fill the expanding chamber which is formed between the teeth of gears 20 and 22 as they come out of mesh. This type of gear pump is, of course, well-known and well-understood by those skilled in the art such that a more detailed description is not considered necessary.

By placing the gear pump 18 in the cylinder block of the engine as shown, the radiated noise level of the pump is greatly reduced in comparison with similar type pumps which are formed in the front cover of the engine. The engine would, of course, be enclosed by another casing, such as a timing gear cover, not shown, however, the pump would not be in direct physical contact with that cover and therefore the noise radiation level is decreased substantially. The use of the pump cover 38 and seal 42 also provides some important functions which are not available with prior art pumps. This structure prevents drainage of the pump cavity when the pump is not in use, improves the priming of the pump on initial startup, and increases the volumetric efficiency of the unit. The volumetric efficiency is increased because of the reduced leakage as a result of the use of the lip-type seal 42.

Obviously, many modifications and variations are possible in light of the above teaching. It is, therefore, to be understood that within the scope of the appended claim the invention may be practiced otherwise than as specifically described.

The embodiments of the invention in which an exclusive property or privilege is claimed are defined as follows:

1. An oil pump and drive for use in an internal combustion engine having a cylinder block and a rotatable shaft, said oil pump and drive comprising; a cavity in said cylinder block having an end wall; a bushing secured in said cavity; an internally and externally toothed external gear rotatably supported in said bushing; a drive gear driven by said rotatable shaft and meshing with the external teeth on said external gear, whereby the external gear is rotated; a bearing support secured to said cylinder block within said cavity; a bearing mounted on said bearing support; an externally toothed internal gear meshing with the internal teeth of said external gear and cooperating therewith to pump oil when said external gear is rotated, said internal gear being rotatably supported on said bearing; a cover plate and seal member secured on said cylinder block only by said bearing support and maintained only by said bearing support in sealing engagement with the side of the external gear facing outwardly from said cavity for enclosing one side of said internal and external gears to prevent oil leakage from between said internal and external gears, said end wall sealing the other side of said internal and external gears; and oil passages formed in said cylinder block and intersecting said end wall of said cavity for communicating oil to and from said pump.

* * * * *